United States Patent [19]

Mooney et al.

[11] 3,985,411

[45] Oct. 12, 1976

[54] HINGED GROUND CLAMP

[75] Inventors: Thomas Mooney, Hungtington Station, N.Y.; John Clark, Willow Springs, Ill.

[73] Assignee: I-T-E Imperial Corporation, East Farmingdale, N.Y.

[22] Filed: June 30, 1975

[21] Appl. No.: 591,409

[52] U.S. Cl. ..... 339/14 L; 339/225; 339/251

[51] Int. Cl.[2] ..... H01R 3/06

[58] Field of Search ..... 339/14 L, 14 R, 13, 339/22 R, 225, 251; 174/78

[56] References Cited

UNITED STATES PATENTS 3,892,455 7/1975 Sotolongo ..... 339/14 L

*Primary Examiner*—Roy Lake
*Assistant Examiner*—DeWalden W. Jones
*Attorney, Agent, or Firm*—Howard C. Miskin

[57] ABSTRACT

An electrical conduit grounding assembly includes a grounding cable parallel to and laterally offset from the conduit and a pair of longitudinally extending dihedral angle clamp members provided with longitudinally serrated confronting concave faces which embrace the conduit and have interdigitating hinge knuckles along their proximal longitudinal edges engaging the grounding cable. A screw engages a tapped bore and an opening in distal wings on the clamp members to permit their tightening. Longitudinal slots may be formed in the knuckles to facilitate their application to the grounding cable.

8 Claims, 4 Drawing Figures

HINGED GROUND CLAMP

BACKGROUND OF THE INVENTION

The present invention relates generally to improvements in ground clamps and it relates more particularly to an improved coupled assembly of an electrical conduit and a grounding cable.

There are many situations which require a firm connection between a conduit, which may be metal pipe or metal hose or electrical conduit both of the rigid type and of the helically wound flexible type, and a cable which may be a solid rod or wire or a stranded cable. Where the conduit is of the electrical type in that it houses electric current carrying conductors, it is often necessary to positively ground the conduit and to this end the cable is grounded and the conduit must be connected positively to the cable by a firm, low resistance coupling. Many types of grounding clamps for interconnecting the electrical conduit and the grounding cable have heretofore been available and proposed but these possess numerous drawbacks and disadvantages. They are awkward and expensive devices, difficult and inconvenient to apply especially in the field and are of little versatility and adaptability. Oftentimes the electrical connection with the grounding wire becomes loose.

SUMMARY OF THE INVENTION

It is a principal object of the present invention to provide an improved coupled cable and conduit assembly.

Another object of the present invention is to provide an improved electrical grounding clamp assembly.

Still another object of the present invention is to provide an improved electrical conduit grounding clamp assembly that positively engages the grounding wire and conduit.

A further object of the present invention is to provide an improved device of the above nature characterized by its ruggedness, simplicity, low cost, ease and rapidity of application, and great versatility and adaptability.

The above and other objects of the present invention will become apparent from a reading of the following description taken in conjunction with the accompanying drawings.

In a sense the present invention contemplates the provision of a conduit cable coupling assembly comprising a longitudinally extending cable, a longitudinally extending conduit laterally spaced from the cable, a pair of clamp members embracing the conduit and provided along their proximal longitudinal edges with hinge knuckles engaging the cable, and means for transversely drawing the distal edges of the clamp members toward each other to contract the clamp members relative to each other and spread the knuckles to produce a positive gripping and electrical connection with the ground wire. As applied to an electrical conduit grounding system, the cable is electrically conducting and grounded so as to bring the conduit to ground potential.

In accordance with a preferred form of the present invention, the hinge knuckles are tubular and interdigitate each other. Each clamp member is of dihedral shape with its concave face serrated with longitudinally extending teeth or ribs and confronting each other, the teeth gripping the face of the conduit. The clamp members are provided at their distal ends with outwardly projecting substantially parallel wings, one of which has a tapped bore and the other an opening, a clamp tightening screw engaging the bore and opening. With the tightening of the screw, the knuckles bite into and slightly kink the cable and form a low resistance connection therewith. In order to facilitate the application of the knuckles to the cable, longitudinal slots are formed in and along the full lengths of the knuckles and are of greater width than the cable. The slots face outwardly.

The improved coupled conduit cable assembly is highly reliable, rugged, simple, of low cost, easy and convenient to rapidly effect coupling and is of great versatility and adaptability. Once assembled, the kinking of the wire, besides making a positive electrical connection, prevents the wire from being drawn through the openings when a pull is exerted on the wire, which often occurs during assembly of a series of parallel ground clamps.

DESCRIPTION OF THE PREFERRED EMBODIMENTS

Figure 1:
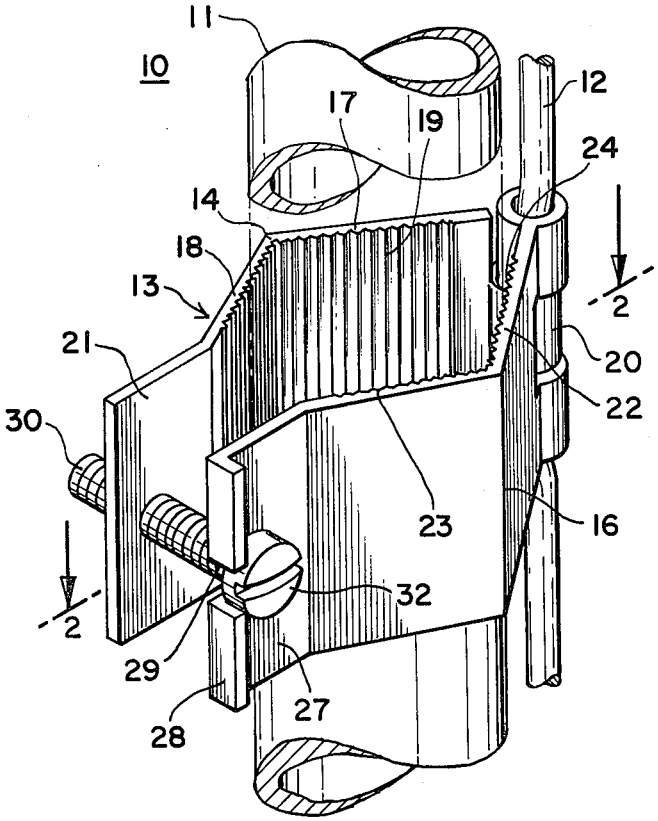
FIG. 1 is a perspective view of a coupled conduit cable assembly embodying the present invention, the conduit and cable being shown by broken line for clarity of illustration.
Figure 2:
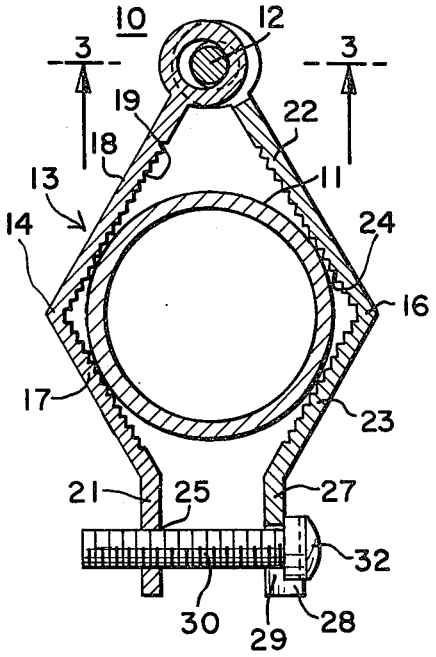
FIG. 2 is a sectional view taken along line 2—2 in FIG. 1.
Figure 3:
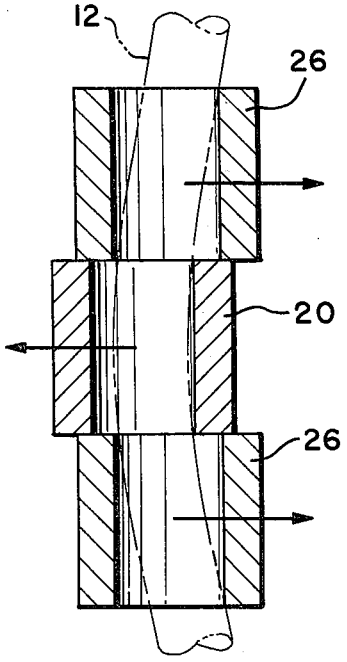
FIG. 3 is a sectional view taken along line 3—3 in FIG. 2.

Referring now to the drawings, particularly FIGS. 1–3 thereof, which illustrate a preferred embodiment of the present invention as applied to the grounding of a rigid conductor carrying electrical conduit, the reference numeral 10 generally designates the improved assembly which includes the conductor housing metal conduit 11, a grounding cable 12 proximate and parallel to the conduit 11 and a conduit cable coupling device or grounding clamp 13. The grounding cable 12 is formed of metal and may be a single conductor or multistranded. While the conduit 11 is illustrated as being of the rigid electrical solid wall type, it may be of the helically wound flexible type and the assembly may be used for other functions than solely grounding the conduit.

The grounding clamp 13 is formed in any suitable manner of metal and includes complementary clamp members 14 and 16 respectively which embrace the conduit 11 and engage the grounding cable 12. The clamp member 14 comprises a main body portion of longitudinally extending dihedral angle configuration including transversely inwardly laterally diverging proximal and distal panel sections 17 and 18 delineating a concave face which is serrated by longitudinally extending parallel teeth or ribs 19. Medially integrally formed along the proximal longitudinal edge of the proximal panel section 17 adjacent to the cable 12 is a longitudinally extending tubular hinge knuckle 20 having an inside diameter greater than the diameter of the cable 12 and occupying about one-third of the edge of the proximal panel 17. The knuckle 20 rotatably engages the grounding cable 12, which is threaded through the opening. Projecting laterally from the distal longitudinal edge of the distal panel section 18 is a flat wing panel 21, having medially formed therein proximate its distal edge, a tapped bore 25.

The clamp member 16 comprises a main body portion similar to that of clamp member 14 including annularly diverging proximal and distal panel sections 22 and 23 delineating a concave face confronting that of clamp member 14 and being serrated with longitudinally extending teeth or ribs 24. A pair of longitudinally spaced hinge knuckles 26, similar to hinge knuckle 20, are integrally formed along the proximal longitudinal edge of the proximal panel section 22 and embrace and interdigitate with the hinge knuckle 20 and engage the grounding cable 12.

Projecting laterally from the digital longitudinal edge of the distal panel section 23 is a flat wing panel 27 terminating along its distal edge in an outwardly transversely projecting flange 28. A laterally medially extending slot 29 is formed in the wing panel 27 and extends through the flange 28. A clamp tightening screw registers with the slot 29 and engages the tapped bore in wing panel 21 and has a slotted head 32, bearing on the outside face of wing panel 27 and the inside face of flange 28.

In the application of the grounding clamp 13 to the conduit 11 and the grounding cable 12, the conduit 11 is brought into traversing engagement between the confronting serrated concave faces of the clamp members 14 and 16. Cable 12 is threaded through the openings of the interdigitating tubular clamp members 14 and 16. The screw 30 is then passed through slot 29 into engagement with the tapped bore in wing panel 21 and tightened to contract the clamp members 14 and 16 into firm tight clamping engagement with the conduit 11, the teeth on the clamp member concave faces biting into the conduit 11 to effect a low electrical resistance connection. With the tightening of the clamp 11 the knuckles 20 and 26, as best seen in FIG. 3, are relatively transversely offset to bite into and kink the grounding cable 12 and also effect a low electrical resistance connection therebetween. Thus a good mechanical and electrical connection is effected between the conduit 11 and grounding cable 12 which prevents inadvertent slippage of the cable during assembly of other ground clamps common to cable 12.

Figure 2A:
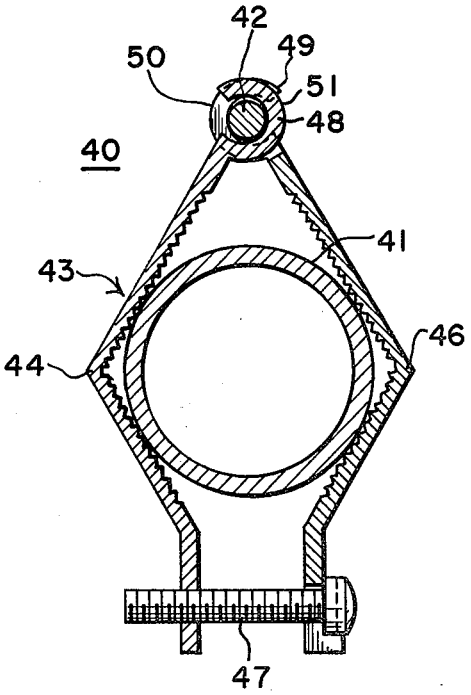
FIG. 2A is a view similar to FIG. 2 of another embodiment of the present invention.

In FIG. 2A of the drawings there is illustrated another embodiment of the present invention which differs from that first described in that slots are formed in the hinge knuckles to facilitate the application of the clamp members to the grounding cables. Specifically, the modified assembly 40 includes a conduit 41, a grounding cable 42 and a grounding clamp 43. The grounding clamp 43 includes clamp members 44 and 46 and a clamp tightening screw 47 of the construction and relationship of the clamp members 14 and 16 and tightening screw 30 described above. Integrally formed along the proximal longitudinal edge of clamp member 44 is a medial tubular hinge knuckle 48 and integrally formed along the proximal edge of clamp member 46 is a pair of longitudinally spaced hinge knuckles 49 and hinge knuckles 48 and 49 interdigitating and engaging the grounding cable 42. Formed in the hing knuckle 48 and extending for the full length thereof adjacent to the outer face of clamp member 44 is a slot 50 of greater width than that of the grounding cable 42 and formed in each hinge knuckle 49 and extending for the full length thereof adjacent to the outerface of clamp member 46 is a slot 51 likewise of greater width than that of the grounding cable 42.

The application of the grounding clamp 43 is similar to that of grounding clamp 13, described earlier, except that the application of clamp members 44 and 46 to the grounding cable 42 is facilitated since the hinge knuckles 48 and 49 may be brought into engagement with the cable 42 by way of the slots 50 and 51. The slots 50 and 51 are positioned on the respective knuckles 48 and 49, so that when clamp members 44 and 46 are in clamped position, the slots are not opening outwardly, but at least one slot opening 50 faces the hinged knuckle 49 of the other clamp member to prevent the cable 42 from being accidentally removed from the tubular opening. Thus cable 42 is slid into hinge knuckles 48 and 49 transversely rather than threaded through the tubular openings as in the first described embodiment and clamp members 44 and 46 rotated into clamping position as seen in FIG. 2A thereby closing the slot opening and forming a closed tubular passageway for cable 42. Assembly 40 can be mounted to an existing grounding cable easily.

Also, tightening screws 30 and 47 can be threaded in their bores and the head slid into its corresponding slot in its mating wing and then tightened and offsetting the knuckles.

While there have been described and illustrated preferred embodiments of the present invention, it is apparent that numerous alterations, omissions and additions may be made without departing from the spirit thereof.

What is claimed is:

1. A conduit coupling assembly comprising a longitudinally extending cable, a longitudinally extending conduit laterally spaced from said cable, a pair of clamp members embracing said conduit and provided along their proximal longitudinal edges with hinge knuckles engaging said cable and terminating at their distal ends in outwardly laterally projecting wings, one of said wings having a tapped bore and the other of said wings having an opening directed toward said bore, and means comprising a screw registering with said opening and engaging said bore for transversely drawing the distal ends, of said clamp members toward each other to contact said clamp members relative to each other.

2. The conduit cable coupling assembly of claim 1 wherein at least one of said clamp members is provided with a plurality of said hinge knuckles in longitudinally spaced axial alognment and said hinge knuckles on said clamp members are interdigitated.

3. The conduit cable coupling assembly of claim 1 wherein said hinge knuckles are of longitudinal tubular configuration.

4. The conduit cable coupling assembly of claim 1 wherein said knuckles have longitudinal slots formed therein and extending for the full lengths thereof proximate the adjacent edges of said clamp members, and being of widths greater than the diameter of said grounding cable.

5. The conduit cable coupling assembly of claim 1 wherein said clamp members have between their proximal and distal edges clamp sections having longitudinally extending confronting concave faces.

6. The conduit cable coupling assembly of claim 5 wherein said clamp sections are of longitudinally extending dihedral angle configuration.

7. The conduit cable coupling assembly of claim 5 wherein said confronting concave faces are longitudinally serrated.

8. A conduit cable coupling assembly comprising a longitudinally extending cable, a longitudinally extending conduit laterally spaced from said cable, a pair of clamp members embracing said conduit and provided along their proximal longitudinal edges with hinge knuckles hingedly retained by and engaging said cable and means disposed proximate the distal ends of said clamp members for transversely drawing the distal ends of said clamp members towards each other.

* * * * *